US005584462A

United States Patent [19]

Reese

[11] Patent Number: 5,584,462

[45] Date of Patent: Dec. 17, 1996

[54] ADJUSTABLE WALL HANGER

[76] Inventor: Douglas M. Reese, 1902 Wildwood Ave., Baltimore, Md. 21234

[21] Appl. No.: 438,088

[22] Filed: May 8, 1995

[51] Int. Cl.[6] ..... A47G 1/24

[52] U.S. Cl. ..... 248/477; 248/339; 248/496

[58] Field of Search ..... 248/339, 477, 248/495, 496, 544

[56] References Cited

U.S. PATENT DOCUMENTS

| | | | |
|---|---|---|---|
| 2,532,162 | 11/1950 | Goss | 248/477 |
| 2,696,962 | 12/1954 | Goss | 248/477 |
| 2,987,832 | 6/1961 | Urbain et al. | 248/477 X |
| 3,724,085 | 4/1973 | Wentworth | 248/544 X |
| 4,340,199 | 7/1982 | Brock | 248/544 |
| 5,201,487 | 4/1993 | Epplett | 248/544 X |
| 5,342,014 | 8/1994 | Wilson | 248/495 X |

*Primary Examiner*—Leslie A. Braun
*Assistant Examiner*—Richard M. Smith

[57] ABSTRACT

A hanger for adjustably suspending an object from a wall. The inventive device includes a wall bracket securable to a wall surface. An adjustable bracket is slidably positioned through the wall bracket and includes a depending hook for suspending an object. A securing fastener is directed through the adjustable bracket and can be rotatably advanced to lock the adjustable bracket relative to the wall bracket in a desired position.

3 Claims, 3 Drawing Sheets

ADJUSTABLE WALL HANGER

BACKGROUND OF THE INVENTION

1. Field of the Invention

The present invention relates to wall hanging devices and more particularly pertains to an adjustable wall hanger for adjustably suspending an object from a wall.

2. Description of the Prior Art

The use of wall hanging devices is known in the prior art. More specifically, wall hanging devices heretofore devised and utilized are known to consist basically of familiar, expected and obvious structural configurations, notwithstanding the myriad of designs encompassed by the crowded prior art which have been developed for the fulfillment of countless objectives and requirements.

While the prior art wall hanging devices fulfill their respective, particular objectives and requirements, the prior art does not disclose an adjustable wall hanger for adjustably suspending an object from a wall which includes a wall bracket securable to a wall surface, an adjustable bracket slidably positioned through the wall bracket and including a depending hook for suspending an object therefrom, and a securing fastener directed through the adjustable bracket which can be rotatably advanced to lock the adjustable bracket in a desired position relative to the wall bracket.

In these respects, the adjustable wall hanger according to the present invention substantially departs from the conventional concepts and designs of the prior art, and in so doing provides an apparatus primarily developed for the purpose of adjustably suspending an object from a wall.

SUMMARY OF THE INVENTION

In view of the foregoing disadvantages inherent in the known types of wall hanging devices now present in the prior art, the present invention provides a new adjustable wall hanger construction wherein the same can be utilized for adjustably hanging an object from a wall. As such, the general purpose of the present invention, which will be described subsequently in greater detail, is to provide a new adjustable wall hanger apparatus and method which has many of the advantages of the wall hanging devices mentioned heretofore and many novel features that result in an adjustable wall hanger which is not anticipated, rendered obvious, suggested, or even implied by any of the prior art wall hanging devices, either alone or in any combination thereof.

To attain this, the present invention generally comprises a hanger for adjustably suspending an object from a wall. The inventive device includes a wall bracket securable to a wall surface. An adjustable bracket is slidably positioned through the wall bracket and includes a depending hook for suspending an object. A securing fastener is directed through the adjustable bracket and can be rotatably advanced to lock the adjustable bracket relative to the wall bracket in a desired position.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new adjustable wall hanger apparatus and method which has many of the advantages of the wall hanging devices mentioned heretofore and many novel features that result in an adjustable wall hanger which is not anticipated, rendered obvious, suggested, or even implied by any of the prior art wall hanging devices, either alone or in any combination thereof.

It is another object of the present invention to provide a new adjustable wall hanger which may be easily and efficiently manufactured and marketed.

It is a further object of the present invention to provide a new adjustable wall hanger which is of a durable and reliable construction.

An even further object of the present invention is to provide a new adjustable wall hanger which is susceptible of a low cost of manufacture with regard to both materials and labor, and which accordingly is then susceptible of low prices of sale to the consuming public, thereby making such adjustable wall hangers economically available to the buying public.

Still yet another object of the present invention is to provide a new adjustable wall hanger which provides in the apparatuses and methods of the prior art some of the advantages thereof, while simultaneously overcoming some of the disadvantages normally associated therewith.

Still another object of the present invention is to provide a new adjustable wall hanger for adjustably suspending an object from a wall.

Yet another object of the present invention is to provide a new adjustable wall hanger which includes a wall bracket securable to a wall surface, an adjustable bracket slidably positioned through the wall bracket and including a depending hook for suspending an object therefrom, and a securing fastener directed through the adjustable bracket which can be rotatably advanced to lock the adjustable bracket in a desired position relative to the wall bracket.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
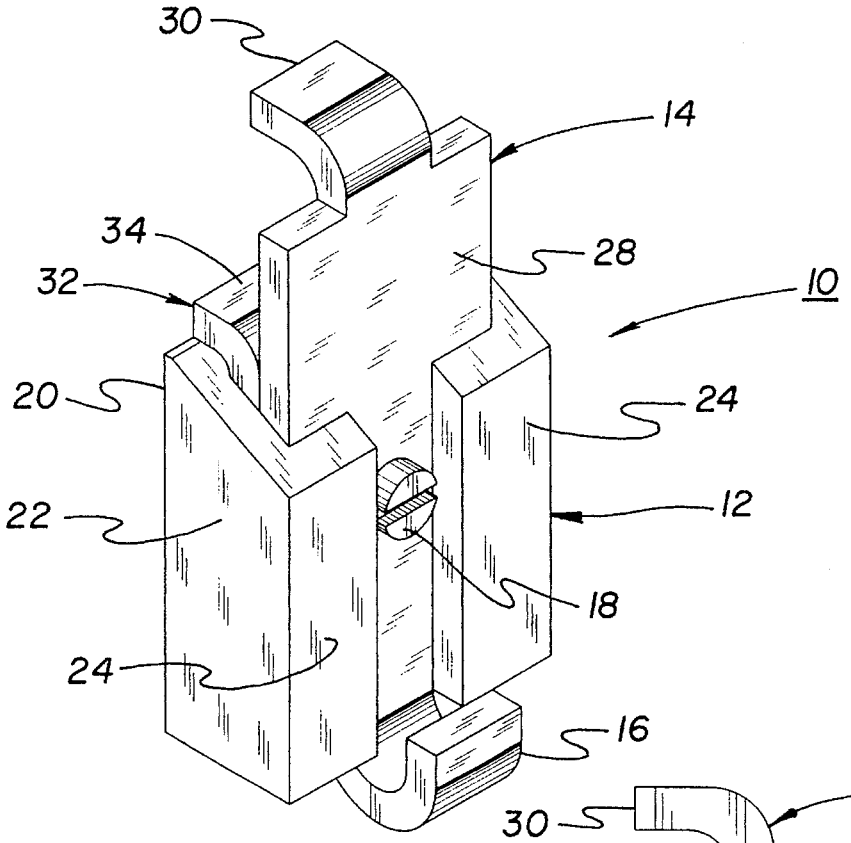
FIG. 1 is an isometric illustration of an adjustable wall hanger according to the present invention.

With reference now to the drawings, and in particular to FIGS. 1–12 thereof, a new adjustable wall hanger embodying the principles and concepts of the present invention and generally designated by the reference numeral 10 will be described.

More specifically, it will be noted that the adjustable wall hanger 10 comprises a wall bracket 12 for securing to a wall surface proximal to an area of such wall surface where a picture or other object is desired to be suspended therefrom. An adjustable bracket 14 is slidably received within the wall bracket 12 and includes a hook 16 depending therefrom which can be engaged to a picture or other object to suspend such object from the adjustable bracket. A securing fastener 18 is threadably directed through the adjustable bracket 14 and engages the wall bracket 12 to secure the adjustable bracket 14 relative thereto. By this structure, the adjustable bracket 14 can be slidably positioned into a desired orientation or height relative to the wall bracket 12, whereby a tightening of the securing fastener 18 will cause an engagement between the adjustable bracket 14 and the wall bracket 12 to secure a relative position therebetween, as shown in FIG. 1 of the drawings.

Figure 2:
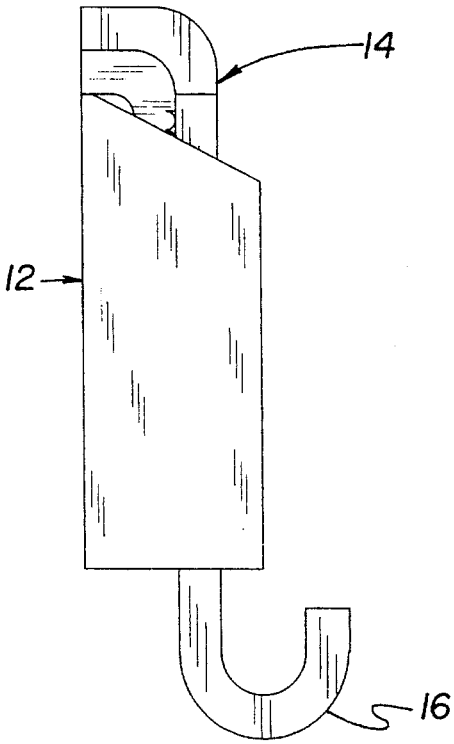
FIG. 2 is a side elevation view thereof.
Figure 3:
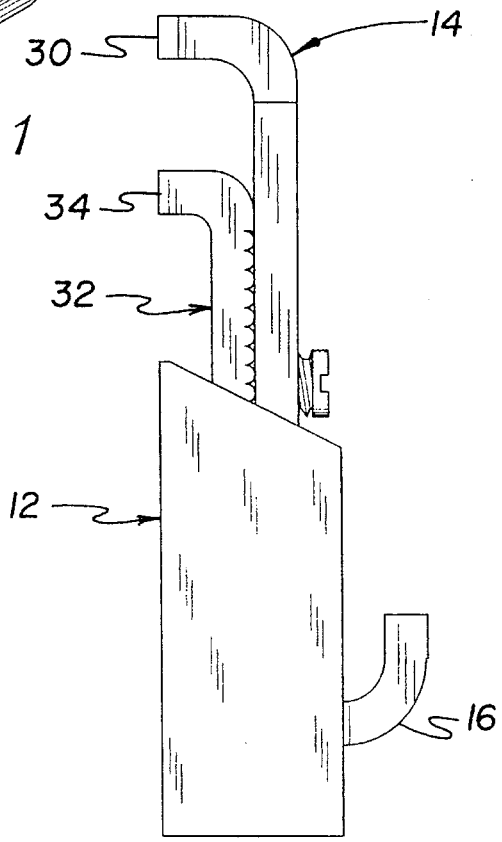
FIG. 3 is a side elevation view of the invention in a partially disassembled configuration.
Figure 4:
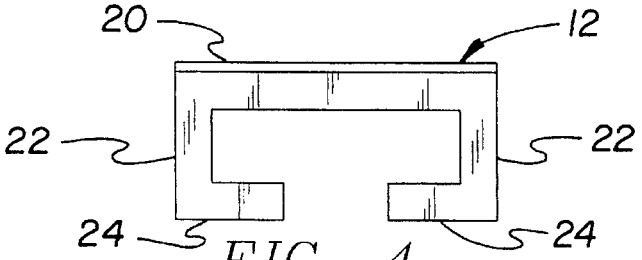
FIG. 4 is a top plan view of a wall bracket comprising a portion of the present invention.
Figure 5:
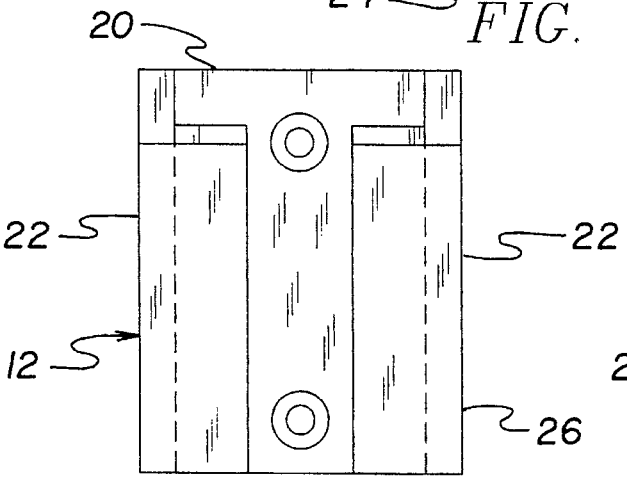
FIG. 5 is a front elevation view of the wall bracket.
Figure 6:
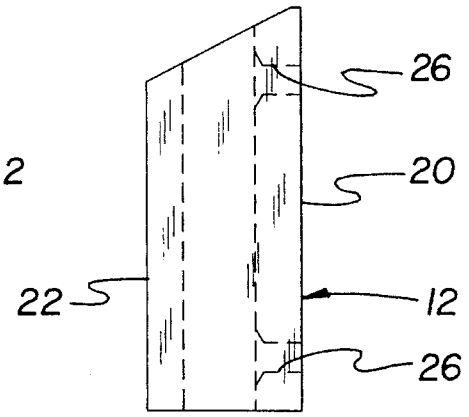
FIG. 6 is a side elevation view of the wall bracket, per se.

Referring now to FIGS. 2 through 6, it can be shown that the wall bracket 12 according to the present invention 10 preferably comprises a substantially planar base plate 20 having opposed vertical edges from which a pair of spaced and substantially parallel lateral plates 22 project. The lateral plates 22 project from the base plate 20 and terminate in outer distal edges whereat a pair of outer plates 24 are mounted. The outer plates 24 project substantially orthogonally relative to the lateral plates 22 and into a substantially spaced and parallel orientation relative to the base plate 20. The lateral plates 22 are spaced a first distance apart, with the outer plates 24 projecting towards one another and terminating in spaced free edges which are spaced a second distance apart, wherein the first distance between the lateral plates 22 is substantially greater than the second distance between the free edges of the outer plates 24 as best shown in FIG. 4 of the drawings. As shown in FIGS. 5 and 6, a plurality of mounting holes 26 are directed through the base plate 20 and facilitate the direction of threaded fasteners or other securing devices through the base plate 20 for engagement to an associated wall surface so as to secure the device 10 relative thereto. The mounting holes 26 are preferably counter-sunk so as to provide for a flush positioning of fasteners directed therethrough relative to an interior surface of the base plate 20. By this structure, the adjustable bracket 14 can be slidably positioned between the lateral plates 22 and secured between the outer plates 24 and the base plate 20 by a rotational tightening of the securing fastener 18 in a manner which will subsequently be described in more detail.

Figure 7:
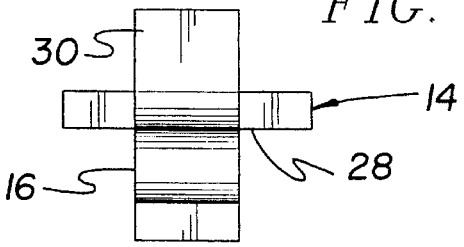
FIG. 7 is a top plan view of an adjustable bracket comprising a portion of the present invention.
Figure 8:
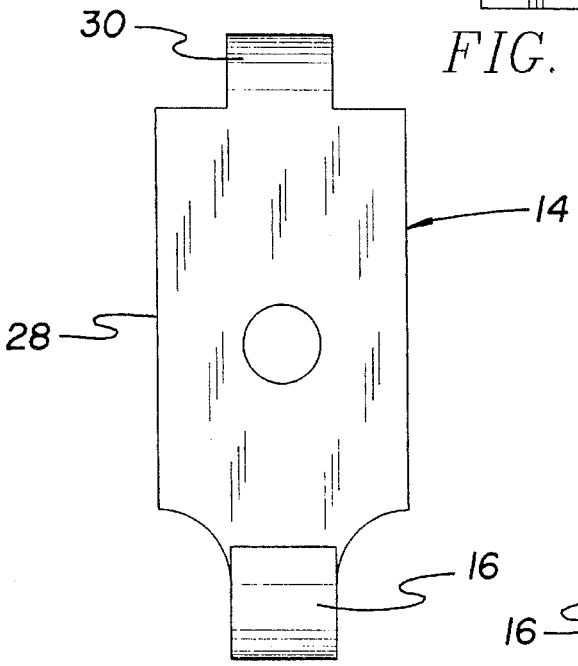
FIG. 8 is a front elevation view of the adjustable bracket.
Figure 9:
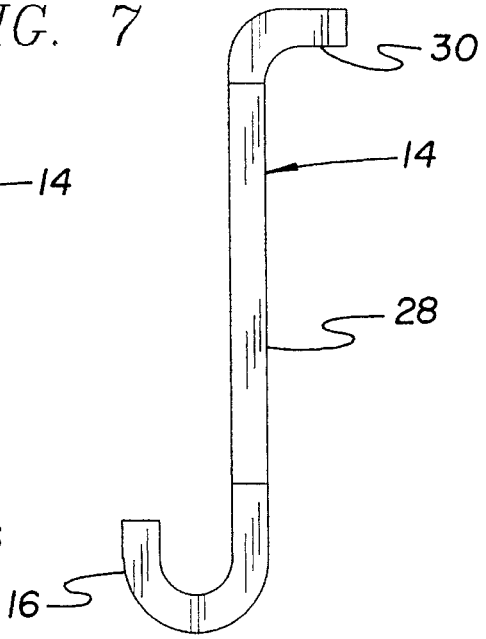
FIG. 9 is a side elevation view of the adjustable bracket, per se.

Referring now to FIGS. 7 through 9 wherein the adjustable bracket is illustrated in detail, it can be shown that the adjustable bracket 14 comprises a substantially rectangular planar member 28 having spaced and parallel longitudinal edges and opposed top and bottom edges. The hook 16 is integrally or otherwise fixedly secured to the lower edge of the planar member 28 and projects in a first direction therefrom. An unlabelled threaded bore is directed through the planar member 28 proximal to a central area thereof and threadably receives the securing fastener 18 therethrough, as shown in FIGS. 1 and 3 of the drawings, to permit the threaded fastener to be advanced towards the base plate 20 to secure a position of the adjustable bracket 14 relative to the wall bracket 12. To preclude a free sliding of the adjustable bracket 14 through the wall bracket 12 when the securing fastener 18 is loosened during adjustment of the device 10, a stop projection 30 desirably extends from a top edge of the planar member 28 and projects in a second direction therefrom oriented opposite relative to the first direction in which the hook 16 projects. The stop projection 30 operates to engage an upper portion of the base plate 20 or other object interposed therebetween to preclude unintentional sliding separation of the adjustable bracket 14 relative to the wall bracket 12.

Figure 10:
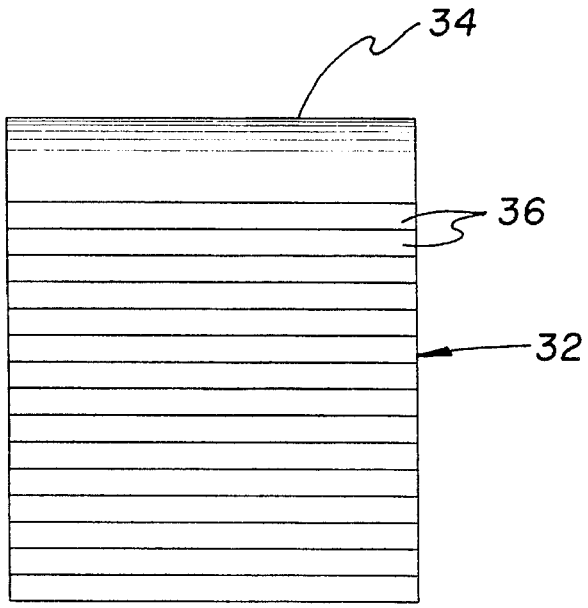
FIG. 10 is a front elevation view of a gripping member comprising at portion of the present invention.
Figure 11:
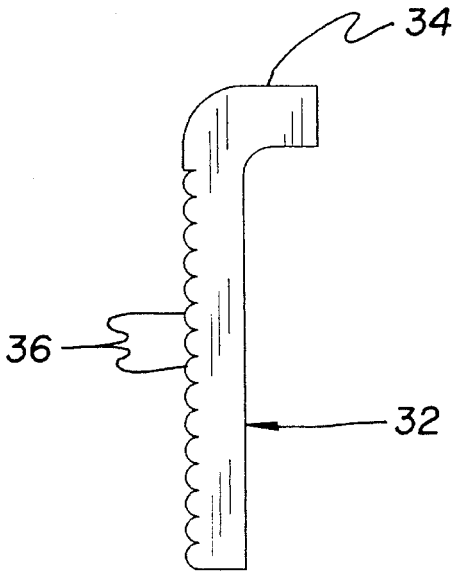
FIG. 11 is a side elevation view of the gripping member.
Figure 12:
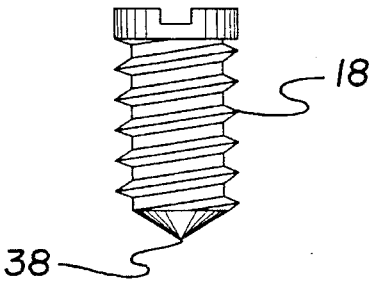
FIG. 12 is an elevation view of a securing fastener of the invention.

Referring now to FIGS. 10 through 12 with concurrent reference to FIGS. 1 through 3, it can be shown that the present invention 10 may further comprise a gripping member 32 interposed between the planar member 28 of the adjustable bracket 14 and the base plate 20 of the wall bracket 12. The gripping member 32 includes a stop projection 34 projecting from an upper end thereof which mechanically engages an upper edge of the base plate 20 so as to limit downward travel of the gripping member 32 through the wall bracket 12 when the device 10 is installed as shown in FIG. 1 of the drawings. The gripping member 32 is shaped so as to define a plurality of transverse projections 36 extending transversely thereacross which cooperate to engage with a conical end 38 formed into the securing fastener 18 so as to positively or mechanically lock the adjustable bracket relative to the gripping member 32 which, in turn, is precluded from translation relative to the wall bracket 12 by the stop projection 34 thereof. By this structure, the adjustable bracket 14 is more securely positionable relative to the wall bracket 12.

In use, the adjustable wall hanger 10 according to the present invention can be easily utilized to adjustably suspend an object such as a painting or other picture from a wall surface. The present invention 10 is particularly useful in the hanging of pictures or other objects which are supported at two or more points along the wall, whereby each of the suspension points can be adjusted so as to horizontally align or position the picture. Further, when a plurality of pictures are hung in a sequential manner along a wall, the present invention 10 allows each picture to be individually adjusted so as to position the pictures into an aligned orientation.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An adjustable wall hanger comprising:

a wall bracket adapted to be secured to a wall surface, wherein the wall bracket comprises a substantially planar base plate having opposed vertical edges; a pair of spaced and substantially parallel lateral plates projecting from the opposed vertical edges of the base plate, the lateral plates terminating in outer distal edges; a pair of outer plates mounted to the outer distal edges of the lateral plates, the outer plates projecting substantially orthogonally relative to the lateral plates and into a substantially spaced and parallel orientation relative to the base plate, with the outer plates projecting towards one another and terminating in spaced free edges;

an adjustable bracket slidably received within the wall bracket and including a hook depending therefrom which can be engaged to an object to be suspended;

a securing fastener threadably directed through the adjustable bracket to secure the adjustable bracket relative thereto; wherein the adjustable bracket comprises a substantially rectangular planar member having spaced and parallel longitudinal edges and opposed top and bottom edges, the hook being fixedly secured to the lower edge of the planar member and projecting in a first direction therefrom, the planar member being shaped so as to define a threaded bore directed therethrough which threadably receives the securing fastener to permit the threaded fastener to be advanced towards the base plate to secure a position of the adjustable bracket relative to the wall bracket, wherein the adjustable bracket further comprises a stop means for operating to preclude a free sliding of the adjustable bracket completely through the wall bracket; and a separate gripping member interposed between the planar member of the adjustable bracket and the base plate of the wall bracket, wherein the gripping member is shaped to engage with a portion of the securing fastener so as to mechanically lock the adjustable bracket relative to the gripping member and further comprises a holding means for operating to preclude a free sliding of the gripping member completely through the wall bracket.

2. An adjustable wall hanger comprising:

a wall bracket adapted to be secured to a wall surface, wherein the wall bracket comprises a substantially planar base plate having opposed vertical edges; a pair of spaced and substantially parallel lateral plates projecting from the opposed vertical edges of the base plate, the lateral plates terminating in outer distal edges; a pair of outer plates mounted to the outer distal edges of the lateral plates, the outer plates projecting substantially orthogonally relative to the lateral plates and into a substantially spaced and parallel orientation relative to the base plate, the lateral plates being spaced a first distance apart, with the outer plates projecting towards one another and terminating in spaced free edges which are spaced a second distance apart, wherein the first distance between the lateral plates is substantially greater than the second distance between the free edges of the outer plates;

an adjustable bracket slidably received within the wall bracket and including a hook depending therefrom which can be engaged to an object to be suspended;

a securing fastener threadably directed through the adjustable bracket and engaging the wall bracket to secure the adjustable bracket relative thereto; wherein the adjustable bracket comprises a substantially rectangular planar member having spaced and parallel longitudinal edges and opposed top and bottom edges, the hook being fixedly secured to the lower edge of the planar member and projecting in a first direction therefrom, the planar member being shaped so as to define a threaded bore directed therethrough which threadably receives the securing fastener to permit the threaded fastener to be advanced towards the base plate to secure a position of the adjustable bracket relative to the wall bracket, wherein the adjustable bracket further comprises a stop projection extending from a top edge of the planar member and projecting in a second direction therefrom oriented opposite relative to the first direction in which the hook projects, the stop projection operating to preclude a free sliding of the adjustable bracket completely through the wall bracket when the securing fastener is closed; and a gripping member interposed between the planar member of the adjustable bracket and the base plate of the wall bracket, wherein the gripping member includes a stop projection projecting from an upper end thereof which mechanically engages an upper edge of the base plate so as to limit downward travel of the gripping member through the wall bracket.

3. An adjustable wall hanger comprising:

a wall bracket adapted to be secured to a wall surface, wherein the wall bracket comprises a substantially planar base plate having opposed vertical edges; a pair of spaced and substantially parallel lateral plates projecting from the opposed vertical edges of the base plate, the lateral plates terminating in outer distal edges; a pair of outer plates mounted to the outer distal edges of the lateral plates, the outer plates projecting substantially orthogonally relative to the lateral plates and into a substantially spaced and parallel orientation relative to the base plate, the lateral plates being spaced a first distance apart, with the outer plates projecting towards one another and terminating in spaced free edges which are spaced a second distance apart, wherein the first distance between the lateral plates is substantially greater than the second distance between the free edges of the outer plates;

an adjustable bracket slidably received within the wall bracket and including a hook depending therefrom which can be engaged to an object to be suspended;

a securing fastener threadably directed through the adjustable bracket and engaging the wall bracket to secure the adjustable bracket relative thereto; wherein the adjustable bracket comprises a substantially rectangular planar member having spaced and parallel longitudinal edges and opposed top and bottom edges, the hook being fixedly secured to the lower edge of the planar member and projecting in a first direction therefrom, the planar member being shaped so as to define a threaded bore directed therethrough which threadably receives the securing fastener to permit the threaded fastener to be advanced towards the base plate to secure a position of the adjustable bracket relative to the wall bracket, wherein the adjustable bracket further comprises a stop projection extending from a top edge of the planar member and projecting in a second direction therefrom oriented opposite relative to the first direction in which the hook projects, the stop projection operating to preclude a free sliding of the adjustable bracket completely through the wall bracket when the securing fastener is closed; and a gripping member interposed between the planar member of the adjustable bracket and the base plate of the wall bracket, wherein the gripping member includes a stop projection projecting from an upper end thereof which mechanically engages an upper edge of the base plate so as to limit downward travel of the gripping member through the wall bracket, wherein the gripping member is shaped so as to define a plurality of transverse projections extending transversely thereacross which cooperate to engage with a portion of the securing fastener so as to mechanically lock the adjustable bracket relative to the gripping member.

* * * * *